United States Patent [19]

Ireland et al.

[11] 4,274,481

[45] Jun. 23, 1981

[54] DRY COOLING TOWER WITH WATER AUGMENTATION

[75] Inventors: Robert G. Ireland; Vernon N. Tramontini, both of Indianapolis, Ind.

[73] Assignee: Stewart-Warner Corporation, Chicago, Ill.

[21] Appl. No.: 86,750

[22] Filed: Oct. 22, 1979

[51] Int. Cl.[3] ..... F28B 9/06; F28F 9/02; F28D 21/00

[52] U.S. Cl. ..... 165/122; 165/39; 165/140; 165/166; 165/DIG. 1

[58] Field of Search ..... 165/DIG. 1, 140, 166, 165/107 R, 122, 167, 39

[56] References Cited

U.S. PATENT DOCUMENTS

| | | | |
|---|---|---|---|
| 2,858,677 | 11/1958 | Stone | 165/141 |
| 3,537,513 | 11/1970 | Austin et al. | 165/140 |
| 4,081,025 | 3/1978 | Donaldson | 165/140 |
| 4,184,536 | 1/1980 | Smith et al. | 165/DIG. 1 |

*Primary Examiner*—Sheldon J. Richter
*Attorney, Agent, or Firm*—Augustus G. Douvas

[57] ABSTRACT

An air cooling tower system for condensing exhaust steam in power plants, that has water cooling augmentation to maintain the plant cooling capacity during high atmospheric temperature periods. The cooling tower includes a plurality of banks of brazed aluminum plate and fin type heat exchangers arranged in inverted "V" shaped sets. These heat exchangers cool ammonia used as the cooling fluid in the primary condenser for the power plant turbine exhaust steam. Each of these heat exchangers has a core consisting of a plurality of parallel aluminum plates spaced apart by fin assemblies that define a plurality of fluid passes. Approximately every other one of these passes has closed sides that open at the ends of the core to headers and define ammonia passes. The passes adjacent the ammonia passes are open at the sides and define air passes that permit the free flow of air transversely through the heat exchanger cores. An additional pass is provided adjacent every fourth one of the ammonia passes and these have closed sides and ends and define the passes for the cooling water. The water passes communicate at the bottom of the core with a water inlet manifold and at the top of the core with a water outlet manifold.

The cooling tower system is designed so that at 55 degrees Fahrenheit air temperatures or below, the cooling air alone will provide the necessary cooling for the ammonia to satisfy plant requirements. Above 55 degrees Fahrenheit air temperature, cooling water from a separate water tank is pumped through the water passes to provide an additional cooling effect to maintain the design cooling capacity.

16 Claims, 10 Drawing Figures

SPECIFICATIONS

| STREAM | A | B | C |
|---|---|---|---|
| FLUID | AIR | AMMONIA | WATER |
| NO. OF PASSAGES | 50 | 49 | 12 |
| FIN HEIGHT, IN. | .750 | .100 | .100 |
| HEAT TRANSFER FIN TYPE | 11.5%PF | PLAIN | 11.5%PF |
| NO. OF FINS PER IN. | 11.3 | 6 | 6 |
| FIN THICKNESS, IN. | .012 | .025 | .012 |
| DISTR. FIN TYPE | —— | —— | 11.5%PF |
| NO. OF FINS PER IN. | —— | —— | 6 |
| FIN THICKNESS, IN. | —— | —— | .012 |
| HEAT TRANSFER LENGTH, IN. | 6.00 | 192.00 | 186.00 |
| FREE STREAM AREA, SQ. FT. | 40.700 | .114 | .035 |
| STREAM VOID VOLUME, CU. FT. | 20.3 | 1.8 | .5 |

STACKING ARRANGEMENT

DRY COOLING TOWER WITH WATER AUGMENTATION

BACKGROUND OF THE PRESENT INVENTION

In recent years interest has grown in the use of dry cooling towers for steam power plant cooling. The term "dry cooling towers" refers to cooling towers that use only air as the cooling fluid. The principal reason for this growth in interest in dry cooling towers is the projected increase in competition for existing water supplies from rivers and lakes between the population, industry and agriculture. In fact, in certain locations in the United States where water supplies are very scarce, all power plants must have dry cooling towers by law.

One of the problems associated with using dry cooling towers, as opposed to an equivalent wet (water) cooling tower, is the severe economic penalty resulting from the higher heat rejection temperature in warm weather. Higher heat rejection temperatures reduce plant output when power demands are likely to be the highest. This loss of capacity would have to be compensated for by excess capacity in the plant or by the purchase of power from other utility systems.

Because of these economic penalties, there is a strong incentive to augment these dry cooling towers through evaporative cooling on hot days using inexpensive water made available at the plant site. These combined wet-dry cooling systems increase plant efficiency and power loss problems can be ameliorated by using only a relatively small quantity of available water when compared to the continuous usage in all-wet cooling towers.

Several methods have been suggested to combine wet and dry cooling systems to satisfy this need. These include: (1) separate wet and dry cooling towers, (2) integrated wet and dry cooling towers, (3) dry cooling towers used with water cooling ponds, (4) dry cooling towers using a water spray over the dry cooling heat exchangers, (5) dry cooling tower systems having a water deluge over the heat exchangers, and (6) water augmented dry towers with active heat transport systems. Many factors must be considered in selecting the most economic advantageous option for a given plant site. These factors include water availability, fuel cost, water cost, elevation and climatology.

One type of water augmented cooling tower system is referred to as a separate channel augmented tower (SCAT) developed in part by the Department of Energy. In this system the basic heat exchanger for the cooling tower is a multi-ported aluminum extruded tube that has integral fins chipped from the tubes. The extruded tube has a plurality of side by side channels. Most of the channels convey ammonia and selected ones of the channels are water channels to increase the cooling of the ammonia by heat transfer to the water. The water is piped to a wet cooling tower either inside the dry tower or to a secondary wet tower outside the dry tower. In this system the air path through the heat exchanger must be very long due to the fact that the air must pass not only across the ammonia channels but also across the water channels. When the water channels are not in use and become passive, there is no heat transfer between the ammonia and the air through the water channels.

It is a primary object, therefore, of the present invention to ameliorate the problems in prior combined wet-dry cooling towers for condensing the exhaust steam in power plants.

SUMMARY OF THE PRESENT INVENTION

In accordance with the present invention, a combined water and air cooling tower is provided and designed so that at ambient temperatures of more than 55 degrees Fahrenheit, water is used to increase the cooling effect of the warmer air.

The cooling tower system includes banks of brazed aluminum plate and fin heat exchangers that condense ammonia vapor from the power plant exhaust steam condenser. The cores of these heat exchangers are installed at 60 degree included angles in a saw-tooth array of four panels of eleven cores each. Nozzles and flanges are provided on manifolds at the ends of each of the cores with ammonia vapor entering the top, condensed vapor leaving at the bottom, and water entering the bottom and warmed water exiting at the top.

Each of the cores is constructed to accept three fluid streams, i.e., an ammonia stream, an air stream and a water stream. The cores consist of a plurality of parallel spaced aluminum plates separated by fins. Alternate streams have closed sides and open ends at the ends of the core and define ammonia streams. The air streams are adjacent the ammonia streams and are open at their sides permitting the free flow of air in a direction transverse to the flow of ammonia. An additional pass is provided adjacent every fourth ammonia pass and these have closed sides and closed ends, and they define the water passes.

Fans are positioned above the banks of heat exchangers in the tower for the purpose of drawing air through the zig-zag banks of heat exchangers. The water source is provided by a separate water tank, air-cooled, and pumps are provided for pumping cool water from the tank to and from the water channels of the heat exchangers. Pumps are also provided for pumping ammonia from the heat exchanger to and from the exhaust steam condenser.

DESCRIPTION OF THE PREFERRED EMBODIMENT

Figure 1:
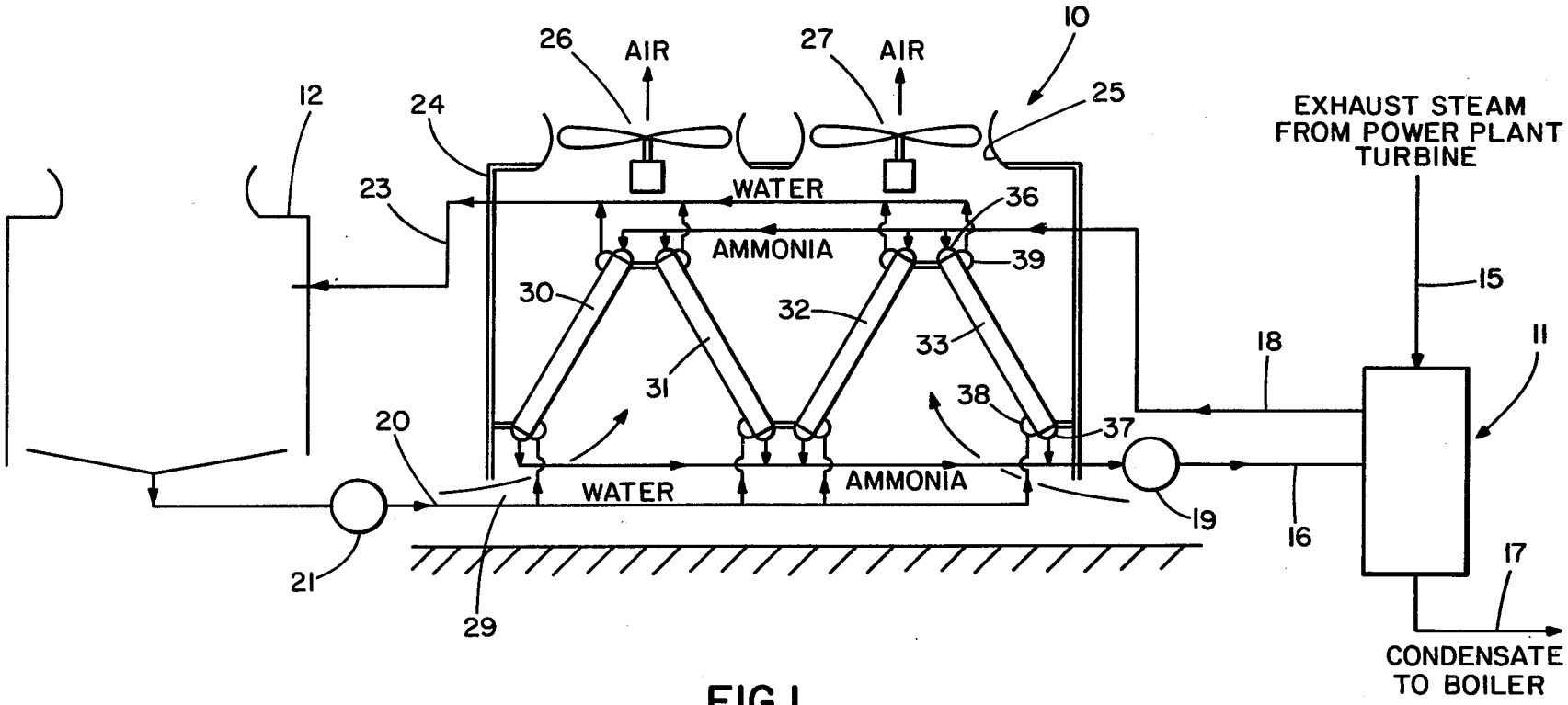
FIG. 1 is a schematic view of the present cooling tower shown in relation to an exhaust steam condenser.

Referring to the drawings, and particularly FIG. 1, a wet-dry cooling tower 10 is illustrated for condensing ammonia vapor from a power plant exhaust steam condenser 11 by air and by water cooling from a separate water tower 12. The cooling tower 10 is designed to transfer 61,200,000 BTUs per hour in the all-dry (air) mode at an air flow rate of 4,706,000 pounds per hour (1,122,800 cfm at 109 degrees Fahrenheit and one atmosphere), and an ammonia flow rate of 136,000 pounds per hour. This assumes an inlet air temperature of 55 degrees Fahrenheit and an ammonia inlet temperature of 125 degrees Fahrenheit and an air outlet temperature of 109 degrees Fahrenheit. During the wet and dry mode, i.e., with water augmentation, the water tower 10 will have the same heat transfer rate, i.e., 61,200,000 BTUs per hour with air entering at 95 degrees Fahrenheit and water entering at 85 degrees Fahrenheit. The heat transfer to air under these conditions is 20,000,000 BTUs per hour and the water heat transfer rate is 41,2000,000 BTUs per hour, which is satisfied by a total water flow rate of 1,200,000 pounds per hour or 2,400 gallons per minute flowing through the water channels in the heat exchangers. The air outlet and water outlet temperatures are about 118 degrees Fahrenheit.

The condenser 11 is conventional and passes exhaust steam from the power plant through line 15 in out-of-contact heat exchange relation with cooled ammonia from the tower 10 through line 16. Exiting condensate passes through line 17 to the power plant boiler. Ammonia vapor from condenser 11 passes to the cooling tower 10 through line 18. An ammonia pump 19 is provided in line 16 for returning the ammonia condensate from the cooling tower 10 to the condenser 11. Cool water is delivered from cooling water tower 12 to the cooling tower 10 through line 20 by water pump 21 therein. Water returns from the cooling tower 10 to the water tower 12 through line 23.

Figure 2:
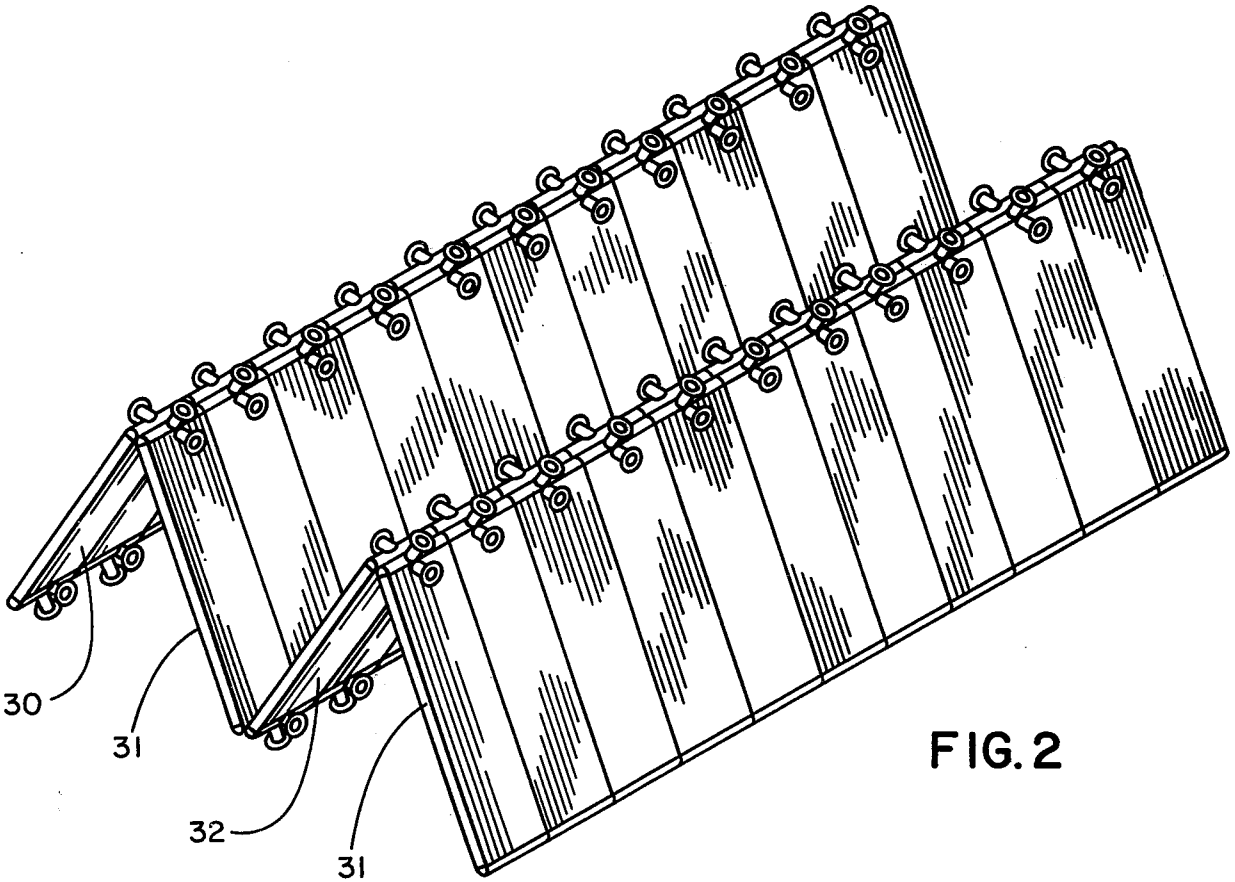
FIG. 2 is a perspective view of the cooling tower heat exchangers.

The cooling tower 10 has a generally rectangular side shroud 24 having an open top 25. Fans 26 and 27 are positioned in the shroud opening 25 and assist in drawing air through the cooling tower 10 from openings 29 at the base of the shroud 24. As seen in FIGS. 1 and 2, the cooling tower 10 has four banks of heat exchangers 30,31,32 and 33 therein in saw-tooth array.

Each of the banks 30,31,32 and 33 has eleven heat exchange cores providing a total of 44 heat exchangers. Each of the heat exchangers is 16 feet in height, 4 feet in width and 6 inches deep. The heat exchangers 30 and 31, as well as heat exchangers 32 and 33, have an included angle of 60 degrees therebetween. Each of the heat exchangers, such as heat exchanger 33, has an ammonia inlet header 36 at the top and an ammonia outlet header 37 at the bottom and a water inlet header 38 near the bottom at one side and a water outlet header 39 near the top at one side. The ammonia inlet headers 36 are connected to receive ammonia vapor from condenser through line 18 and the ammonia condensate headers 37 are connected to convey ammonia through line 16 to condenser 11. The water inlet headers 38 are connected to receive water from tower 12 through line 20 and the water outlet headers 39 are connected to convey water through return conduit 23 to the water tower 12.

As seen best in FIGS. 4 to 8, ammonia inlet header manifold 36 has an inlet nozzle 41 with flanges 42 and ammonia outlet manifold 37 has an outlet nozzle 44 with flanges 45. Similarly, the water inlet manifold 38 has an inlet nozzle 46 with flanges 47 and water outlet manifold 39 has a water outlet nozzle 49 with flanges 51 connected thereto. Upper brackets 52 and 53 are provided fixed to the ammonia inlet header 36 and bottom brackets 55 and 56 are provided attached to ammonia outlet manifold 37 so that the heat exchangers may be fixed within the cooling tower 10. It should be understood that the heat exchanger 33 shown in FIGS. 4–8 represents only one of the 44 heat exchangers shown in FIG. 2 with the understanding that all of the heat exchangers are identical in construction.

Figure 3:
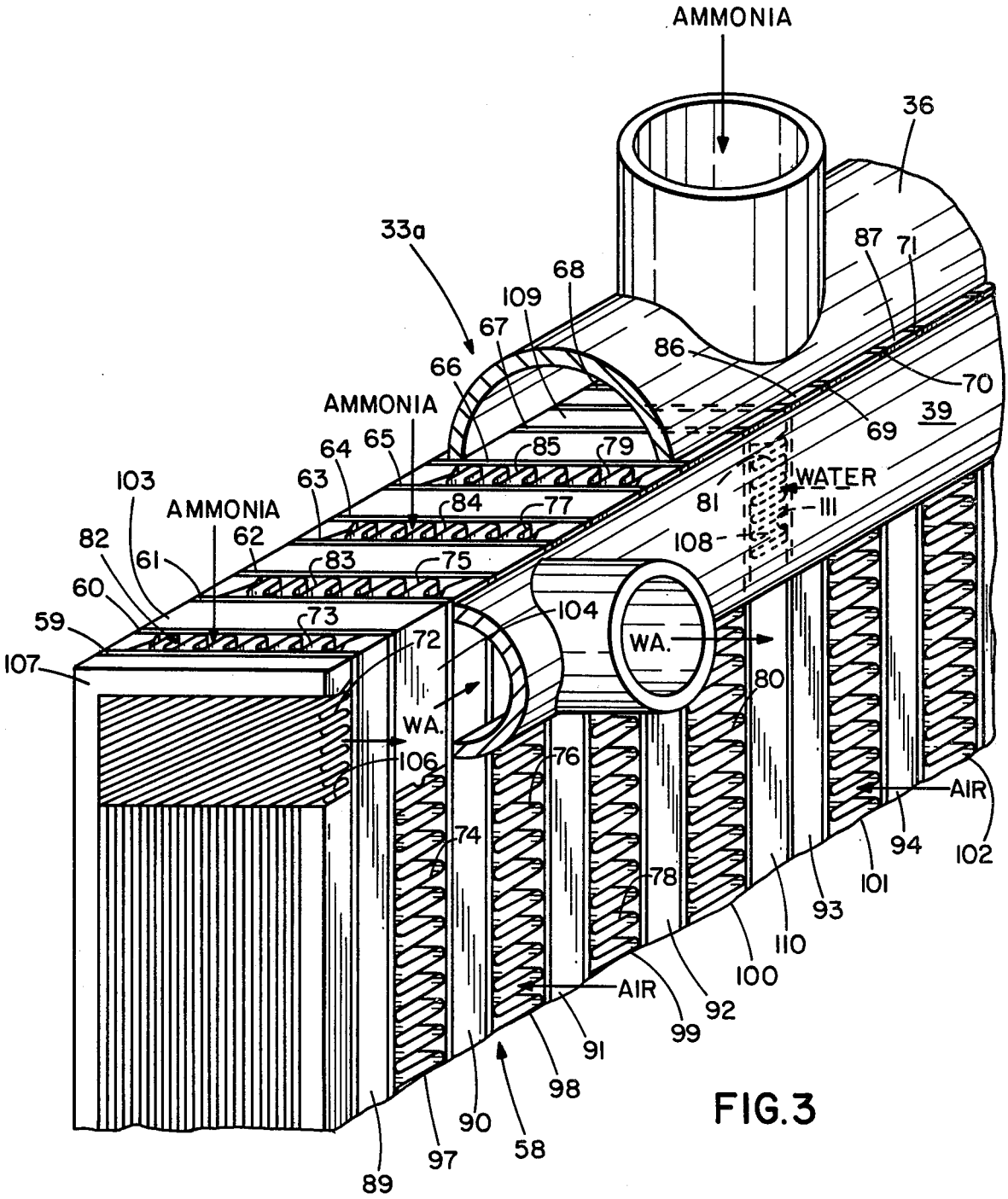
FIG. 3 is a fragmentary perspective view, partly in section, of the top portion of one of the heat exchangers shown in FIGS. 1.
Figure 4:
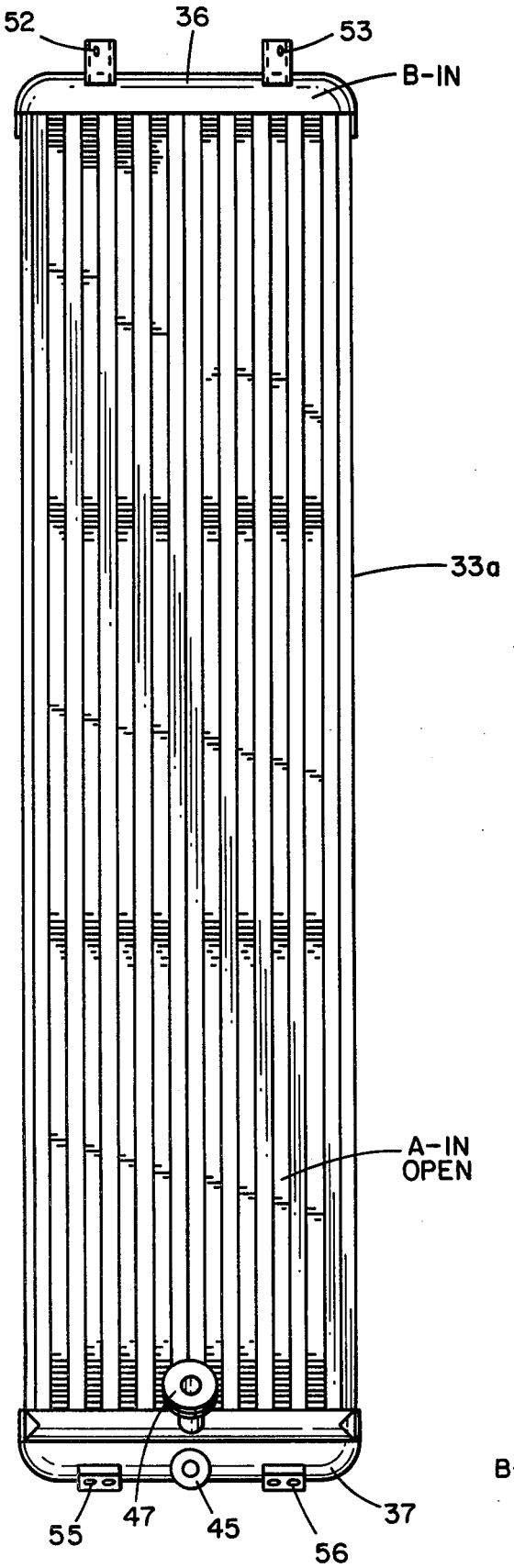
FIG. 4 is a front view of one of the heat exchangers shown in FIGS. 1 and 2.
Figure 5:
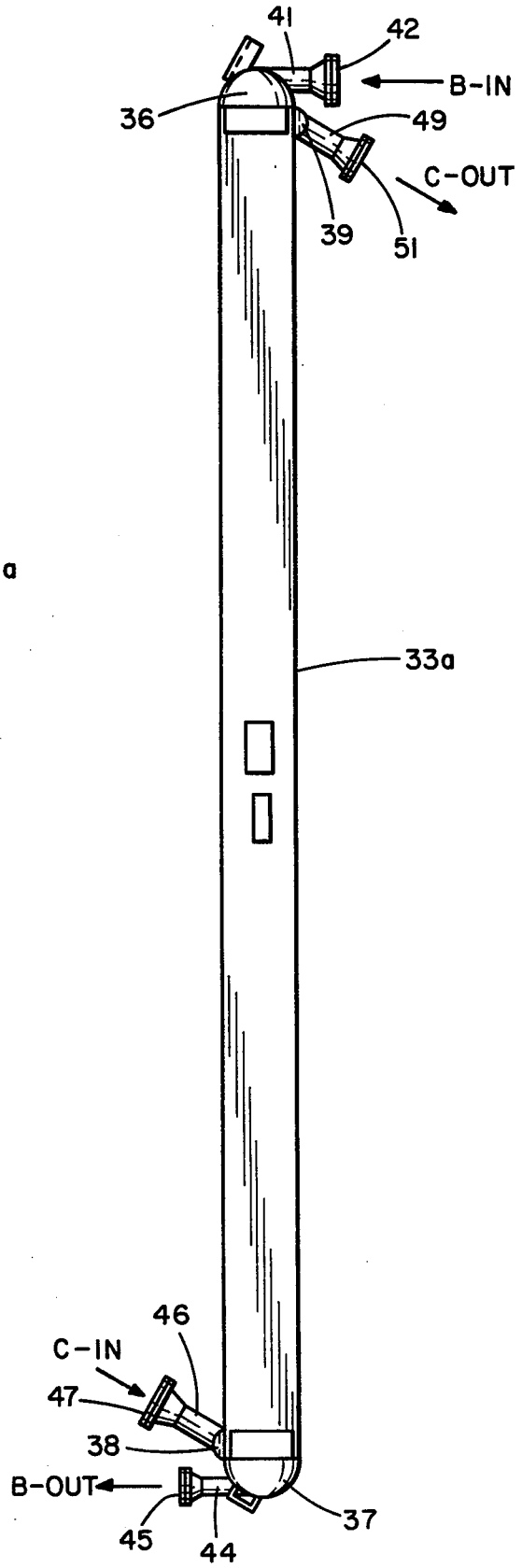
FIG. 5 is a right side view of one of the heat exchangers shown in FIGS. 1 and 2.
Figure 6:
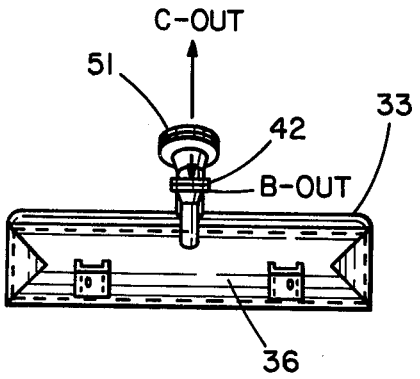
FIG. 6 is a top view of one of the heat exchangers shown in FIGS. 1 and 2.
Figure 7:
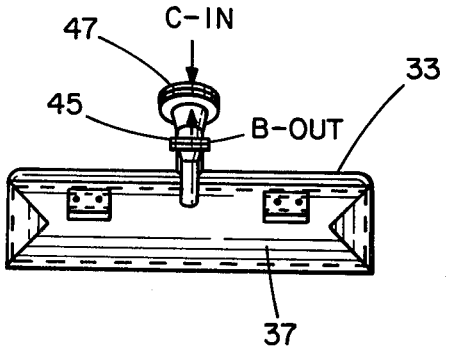
FIG. 7 is a bottom view of one of the heat exchangers shown in FIGS. 1 and 2.
Figure 8:
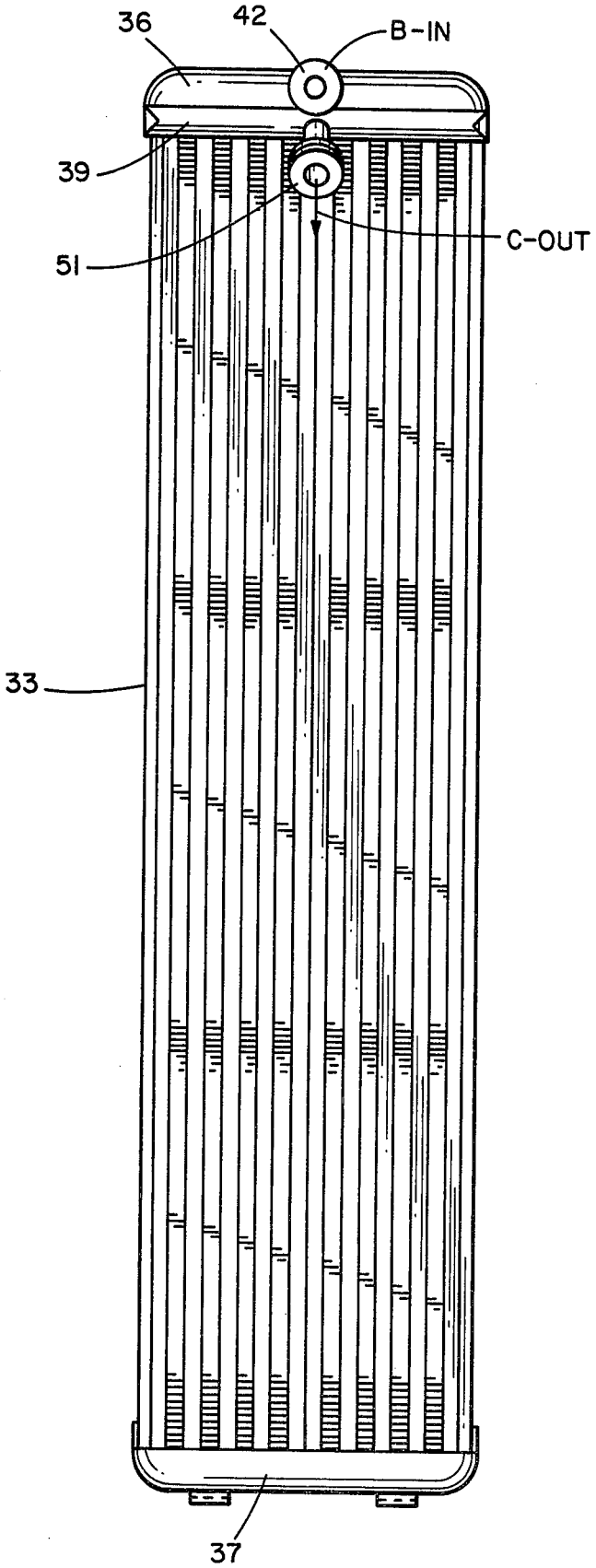
FIG. 8 is a rear view of one of the heat exchangers shown in FIGS. 1 and 2.

A more detailed view of the upper portion of one of the heat exchangers is illustrated in FIG. 3. This construction is also representative of the construction of all of the heat exchangers in the cooling tower 10.

As seen in FIG. 3, heat exchanger **33*a* includes a core 58 including a plurality of spaced aluminum plates 59,60,61,62,63,64, 65,66,67,68,69,70 and 71, and separated by fins 72,73,74,75,76,77,78, 79,80,81, etc. These plates and fins define fluid passes for the air, ammonia and water flowing through the heat exchanger core 58**.

The passes between plates 59,60—between plates 68,69—between plates 70,71 are ammonia passes 82,83,84,85,86, and 87. The fins 73,75,77,79, etc. in the ammonia passes are 0.1 inch high, without perforations, 0.025 inch thick, spaced at 6 fins per inch. Side members, such as members 89,90,91,92,93 and 94, flank the sides of the ammonia passes to provide closed vertical channels for the condensing ammonia passing downwardly. The ammonia passes open at the top to the ammonia inlet header 36 and at the bottom to ammonia outlet header 37. It should be understood that header 36 is broken away in FIG. 3 for clarity only.

Air streams 97,98,99,100,101 and 102 are provided spaced adjacent and alternate with the ammonia streams. The air streams 97 to 102 are open at the sides of the core and have their upper ends closed by blocks 103, blocking communication with the ammonia inlet manifold 36 and similar blocks are provided at their lower ends blocking communication with the ammonia outlet manifold. Blocks 103 have ends 104 that block communication between the air passes and the interior of the water outlet manifold, and similar blocks are provided at the lower end of the core 58 to block communication between the air passes and the water inlet manifold 38.

The air fins 74,76,78,80, etc. in the air passes are 0.750 inch high, 0.012 inch thick, spaced 11.3 fins per inch. These fins have an 11½ percent perforation to provide enhanced heat transfer while maintaining a low pressure drop. These perforations are 0.078 inch in diameter, spaced 0.156 with a 0.270 inch pitch.

Figures 9, 10:
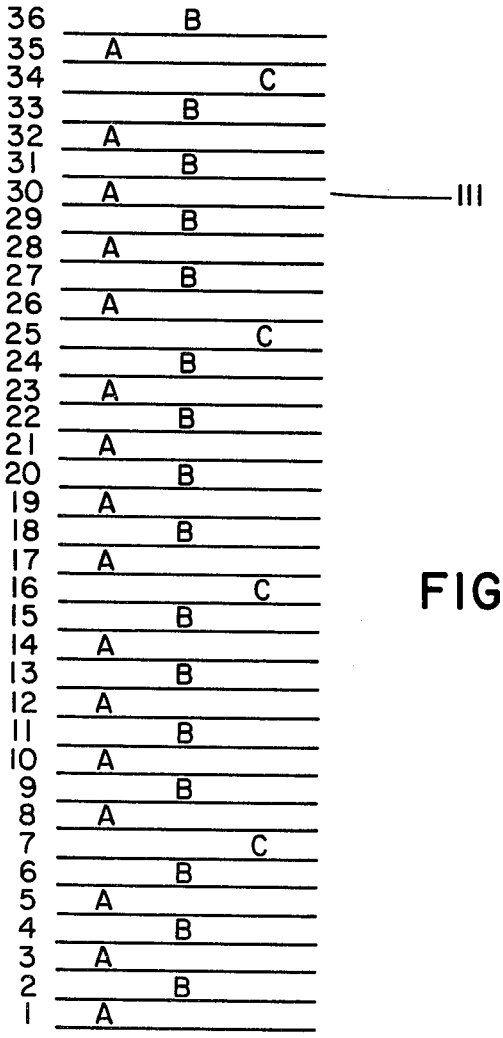
FIG. 9 is a chart showing the specific dimensional configuration of one of the heat exchangers shown in FIGS. 1 and 2.
FIG. 10 is a chart illustrating the repetition of each of the water, air and ammonia fluid streams in part of one of the heat exchangers shown in FIGS. 1 and 2.

Ammonia pass 82 has a water pass 106 contiguous therewith and defined by plate 59 and an end box member 107 closed on all sides with plate 59 except for an upper rectangular side opening 106 communicating with the interior of water outlet manifold 39 and a similar lower side opening (not shown) communicating with the water inlet manifold 38. The end of the box member 107 is broken away in FIG. 3 merely to show the angle of the fins 72. Also, the water outlet manifold 39 encloses opening 106 and is broken away in FIG. 3 only for clarity. A second water pass 108 is provided between ammonia pass 86 and air pass 100 defined between plates 67 and 68 having the fins 81 therein. This pass is closed on all sides such as by top member 109 and side member 110 except for an upper side opening 111 communicating with the interior of water outlet manifold 39, and a similar opening (not shown) at the lower end of the core communicating pass 108 with the water inlet manifold 38. The fins, such as fins 72,81, in the water passes are 0.100 inch high, 0.012 inch thick, spaced at six fins per inch and perforated 11½ percent. The water passes throughout the heat exchanger are positioned adjacent every fourth ammonia pass between an ammonia pass and an air pass. The frequency of occurrence of the air, water and ammonia passes can be seen by the chart in FIG. 10. While only 36 passes are shown in FIG. 10, and less in FIG. 3, it should be understood that each of the heat exchangers has a total of 111 passes, and the frequency of repetition and stacking arrangement shown in FIG. 10 is the same for all 111 passes.

The core 58 is a furnace brazed assembly having die formed fins, extruded side bars or plates, such as bars 89,90, etc. and brazed-alloy clad separator sheets, such as plates 59,60, etc.

In the dry mode, ammonia passes downwardly through the ammonia passes in the heat exchanger while air passes transversely through the cores through the air passes exhausting upwardly through tower opening 25. In the wet-dry mode, cool water is pumped upwardly through the cores in the water passes in out-of-contact heat exchange relation with downwardly flowing ammonia in every fourth ammonia pass.

During use of the cooling tower 10 in cool weather, water is drained from the water channels 106,108. In this manner the air fins adjacent to the water passes will be almost effective as the remaining air fins when the water channels are not in use, since heat will be transferred from the ammonia passes through the fins in the water channels to the air passes.

What is claimed is:

1. A cooling system for condensing the exhaust steam in a power plant, comprising; a condenser for passing the exhaust system in out-of-contact heat exchange relation to a cooling fluid, a heat exchanger for cooling the cooling fluid including a plurality of spaced plates defining therebetween a plurality of side by side fluid passes, a plurality of fins in at least some of said passes, a plurality of said passes having closed sides and defining cooling fluid passes, a second plurality of said passes having closed sides and defining water passes positioned directly adjacent and in heat exchange relation with said cooling fluid passes, a third plurality of said passes being open at the sides and defining air passes, means to convey cooling fluid from the condenser to the heat exchanger cooling fluid passes, and means to convey water to the heat exchanger water passes.

2. A cooling system for condensing the exhaust steam in a power plant as defined in claim 1, wherein there are fins in all of said passes between the plates.

3. A cooling fluid system for condensing the exhaust steam in a power plant as defined in claim 1, wherein said heat exchanger is a brazed aluminum plate and fin heat exchanger, a cooling fluid inlet manifold at the top of said heat exchanger, a cooling fluid outlet manifold at the bottom of said heat exchanger, a water inlet manifold at the bottom of said heat exchanger, and a water outlet manifold at the top of the heat exchanger adjacent the cooling fluid inlet manifold.

4. A cooling fluid system for condensing the exhaust steam in a power plant as defined in claim 1, including a plurality of said heat exchangers, said heat exchangers being arranged in inverted V-shaped banks, and fans positioned above said banks of heat exchangers to draw air through the air passes, and a water cooler for supplying the water delivered to the water passes of the heat exchangers.

5. A cooling system for condensing exhaust steam in a power plant, comprising; a condenser for passing the exhaust steam in out-of-contact heat exchange relation to a cooling fluid, a heat exchanger for cooling the cooling fluid including a plurality of spaced plates defining therebetween a plurality of side by side fluid passes, a plurality of said passes having closed sides and defining cooling fluid passes for receiving said cooling fluid, a second plurality of said passes having closed sides and defining secondary cooling fluid passes positioned directly adjacent and in heat exchange relation with said cooling fluid passes, means to convey a secondary cooling fluid to said secondary cooling fluid passes, and a third plurality of said passes being open at the sides and defining air passes in heat exchange relation to said cooling fluid passes.

6. A cooling system for condensing the exhaust steam in a power plant, comprising; a condenser for passing the exhaust steam in out-of-contact heat exchange relation to a cooling fluid, a heat exchanger for cooling the cooling fluid including a plurality of spaced plates defining therebetween fluid passes, a plurality of fins in at least some of said passes, a plurality of said passes having closed sides and defining cooling fluid passes, a secondary plurality of passes having closed sides and defining water passes, a third plurality of said passes being open at the sides and defining air passes, and means to convey cooling fluid from the condenser to the heat exchanger cooling fluid passes, and means to convey water to the heat exchanger water passes, said air passes are positioned substantially alternately with said cooling fluid passes, said water passes being positioned adjacent said cooling fluid passes and occurring no greater than every third cooling fluid pass.

7. A brazed aluminum plate and fin heat exchanger for providing secondary cooling for power plant exhaust steam, comprising; a core including a plurality of spaced aluminum plates forming passes therebetween with aluminum fins positioned in at least some of said passes, a plurality of said passes being cooling fluid passes, a second plurality of said passes being positioned adjacent the cooling fluid passes and defining air passes, a third plurality of said passes being positioned directly adjacent only selected ones of said cooling fluid passes and defining water passes, a first manifold positioned adjacent one end of said core communicating with the cooling fluid passes and defining a cooling fluid inlet, a second manifold positioned adjacent the other end of said core and communicating with said cooling fluid passes and defining a cooling fluid outlet, a third manifold positioned adjacent one end of said core communicating with said water passes and defining a water inlet, and a fourth manifold positioned adjacent the other end of said core communicating with the water passes and defining a water outlet.

8. A brazed aluminum plate and fin heat exchanger for providing secondary cooling for power plant exhaust steam as defined in claim 7, wherein said cooling fluid passes have closed side members extending between the plates, said water passes having closed side members extending between the plates, and said air passes having fins extending therethrough and being open between the plates so that air flows generally at right angles to the cooling fluid passes and the water passes.

9. A brazed aluminum plate and fin heat exchanger for providing secondary cooling for power plant exhaust steam as defined in claim 7, wherein the cooling fluid inlet manifold and the cooling fluid outlet manifold are on the ends of the core, and said inlet water manifold and said outlet water manifold being on the sides of the core adjacent the ends thereof.

10. A brazed aluminum plate and fin heat exchanger for providing secondary cooling fluid for power plant exhaust steam as defined in claim 7, wherein the cooling fluid is ammonia, means conveying ammonia to the cooling fluid inlet manifold and from the cooling fluid outlet manifold, a water cooler, means conveying water from the water cooler to the water inlet manifold and from the water outlet manifold to the water cooler.

11. A brazed aluminum plate and fin heat exchanger for providing secondary cooling for ammonia that condenses exhaust steam in a power plant, comprising; a heat exchange core including a plurality of parallel spaced aluminum plates forming passes therebetween, a plurality of said passes having longitudinally extending fins therein and defining ammonia passes, each of said ammonia passes having side members interconnecting adjacent plates, an ammonia inlet manifold communicating with said ammonia passes and positioned on one end of the core, an ammonia outlet manifold communicating with said ammonia passes and positioned on the other end of said core, a second plurality of said passes having transversely extending fins and defining air passes, said air passes being adjacent to and substantially alternating with said ammonia passes, said air passes being open at the sides to permit air to pass therethrough, a third plurality of said passes having angularly positioned fins therein and defining water passes, said water passes having side members interconnecting adjacent plates and being positioned directly only adjacent selected ones of said ammonia passes, a water inlet manifold communicating with said water passes and positioned on the side of the core at said other end thereof, and a water outlet manifold communicating with said water passes and positioned on the side of the core at said other end thereof, and a water outlet manifold communicating with said water passes and positioned on the side of said core at said one end of the core adjacent the ammonia inlet manifold.

12. A brazed aluminum plate and fin heat exchanger for providing secondary cooling for ammonia that condenses exhaust steam in a power plant as defined in claim 11, including a plurality of heat exchangers arranged in banks positioned in inverted V-shaped configuration, means supplying ammonia to said ammonia inlet manifold, means supplying water to said water inlet manifold, and means for drawing air through the air passes in the core.

13. A water, air and ammonia cooling system for condensing exhaust steam from a power plant, comprising; a condenser having first and second passes for exhaust steam and ammonia in out-of-contact heat exchange relation, a cooling tower for the ammonia including a plurality of brazed aluminum plate and fin heat exchange cores with headers, each of said heat exchange cores including a plurality of plates separated by fins defining a plurality of side by side fluid passes therethrough, approximately alternate ones of the fluid passes being open at the sides of the heat exchange core to provide a plurality of air passes, approximately alternate second ones of the fluid passes being closed at the sides of the heat exchange core and defining a plurality of ammonia passes communicating with said condenser to receive ammonia therefrom, conduit means connecting the ammonia passes to return ammonia to the condenser, and third ones of said fluid passes in the heat exchange core being closed and positioned adjacent selected ones of the ammonia passes and defining a plurality of water passes, a water heat exchanger, and conduit means for conveying water from the water heat exchanger to and from water passes in the heat exchange core.

14. A water, air and ammonia cooling system for condensing exhaust steam from a power plant as defined in claim 1, wherein each of the water passes are between an ammonia pass and an air pass.

15. A water, air and ammonia cooling system for condensing exhaust steam from a power plant as defined in claim 1, wherein said plurality of heat exchange cores and headers includes a plurality of banks of heat exchange cores and headers arranged in zig-zag fashion, and a plurality of air fans above the heat exchange cores and headers.

16. A water, air and ammonia cooling system for condensing exhaust steam from a power plant, comprising; a condenser having first and second passes for exhaust steam and ammonia in out-of-contact heat exchange relation, a cooling tower for the ammonia including a plurality of brazed aluminum plate and fin heat exchange cores with headers, each of said heat exchange cores including a plurality of plates separated by fins defining a plurality of fluid passes therethrough, approximately alternate ones of the fluid passes being open at the sides of the heat exchange core to provide a plurality of air passes, approximately alternate second ones of the fluid passes being closed at the sides of the heat exchange core and defining a plurality of ammonia passes communicating with said condenser to receive ammonia therefrom, conduit means connecting the ammonia passes to return ammonia to the condenser, and third ones of said fluid passes in the heat exchange core being closed and positioned adjacent selected ones of the ammonia passes and defining a plurality of water passes, a water heat exchanger, and conduit means for conveying water from the water heat exchanger to and from the water passes in the heat exchange core, said water passes being adjacent every fourth ammonia pass.

* * * * *